US011938591B2

(12) United States Patent
Liao et al.

(10) Patent No.: US 11,938,591 B2
(45) Date of Patent: Mar. 26, 2024

(54) SHOT BLASTING CABINET WITH ADJUSTABLE IMPELLERS

(71) Applicant: KUNSHAN AIRBAG PACKING CORP., Kunshan (CN)

(72) Inventors: Tai-An Liao, New Taipei (TW); Kao-Hsiung Liao, New Taipei (TW); Ping-Yuan Liao, New Taipei (TW); Tsai-Ming Kuo, New Taipei (TW)

( * ) Notice: Subject to any disclaimer, the term of this patent is extended or adjusted under 35 U.S.C. 154(b) by 721 days.

(21) Appl. No.: 17/120,264

(22) Filed: Dec. 14, 2020

(65) Prior Publication Data

US 2021/0308830 A1 Oct. 7, 2021

(30) Foreign Application Priority Data

Apr. 6, 2020 (TW) ..... 109203921

(51) Int. Cl.
*B24C 3/14* (2006.01)
*B24C 1/10* (2006.01)
*B24C 5/06* (2006.01)

(52) U.S. Cl.
CPC ..... *B24C 3/14* (2013.01); *B24C 1/10* (2013.01); *B24C 5/06* (2013.01)

(58) Field of Classification Search
CPC .... B24C 3/14; B24C 1/10; B24C 5/06; B24C 5/066; B24C 9/00; B24C 3/08; B24C 3/083; B24C 3/085; B24C 3/10; B24B 3/04
See application file for complete search history.

(56) References Cited

U.S. PATENT DOCUMENTS 4,603,516 A * 8/1986 Hoffman ..... B24C 3/06 451/92
8,062,095 B2 * 11/2011 Voges ..... B24C 1/086 451/39

FOREIGN PATENT DOCUMENTS

DE 202015104319 U1 * 11/2015 ..... B24C 3/04

OTHER PUBLICATIONS

Stp Strahltechnik Pliezhausen & Co KG GmbH Publication Oct. 19, 2015 retrieved translation from Google Patents: https://patents.google.com/patent/DE202015104319U1/en?oq=DE+202015104319+U1 (Year: 2015).*

* cited by examiner

*Primary Examiner* — Joel D Crandall
*Assistant Examiner* — Christopher Soto
(74) *Attorney, Agent, or Firm* — Li & Cai Intellectual Property Office

(57) ABSTRACT

A shot blasting cabinet with adjustable impellers includes a cabinet, a plurality of impeller apparatuses, and a plurality of adjusting devices. A shot-blasting working line is defined between an inlet and an outlet of the cabinet. The impeller apparatuses are symmetrically disposed on upper and lower sides of the cabinet. Each impeller apparatus has a protective housing, a driving device, a pair of rotary plates, and a plurality of impeller blades. The driving device connects one of the rotary plates. The protective housing covers the pair of rotary plates and the impeller blades, and defines a shot-blasting exit surface. The shot-blasting exit surface communicates with an interior of the cabinet. The adjusting devices are used to adjust an angle and a distance of the shot-blasting exit surface relative to the shot-blasting working line.

7 Claims, 12 Drawing Sheets

SHOT BLASTING CABINET WITH ADJUSTABLE IMPELLERS

CROSS-REFERENCE TO RELATED PATENT APPLICATION

This application claims the benefit of priority to Taiwan Patent Application No. 109203921, filed on Apr. 6, 2020. The entire content of the above-identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a shot blasting cabinet with adjustable impellers, and more particularly to a shot blasting cabinet having a plurality of impeller apparatuses, in which the impeller apparatuses combine advantages of sand blasting and shot peening, and a height and a shot-blasting angle of the impeller apparatus are adjustable for blasting particles at a high speed, so as to form a frosted surface or an abrasive surface on a workpiece to be processed for purposes of rust removal, oxide layer removal, stress treatment, friction coefficient adjustment, etc.

BACKGROUND OF THE DISCLOSURE

Sand blasting is one of the conventional methods for surface finishing of a workpiece. It is commonly seen in sand blasting to shoot a blasting material (such as ceramic sands, glass beads, nylon sands, quartz sands, emery grits, and iron sands) onto a surface of a workpiece at a high speed by using compressed air as power, so that an exterior or a shape of the workpiece is changed. Due to impact and cutting done by the blasting material on the surface of the workpiece, the surface of the workpiece is cleaned to a certain extent and can have different degrees of roughness, and a mechanical property of the surface of the workpiece is improved. However, when the compressed air is used as the power to accelerate sand blasting, the shooting speed of the blasting material is subjected to certain limitations.

Another similar method for surface finishing is shot peening, which is a cold working process and is to have the surface of the workpiece being continuously struck by a plurality of round and small steel beads. Each of the plurality of steel beads strikes the surface of the workpiece (e.g., a metal component) makes a small indentation or a recess, so that the surface can be hardened to achieve the effect of increased hardness. During the process of shot peening, a plurality of recesses are formed on the surface of the workpiece, and a surface layer of the metal component is extended. Such recesses can relieve residual stress during casing, forging or welding, and results in lattice compression, so as to further increase the hardness of the surface of the workpiece.

Although the principle of shot peening is similar to that of sand blasting, there are many differences in terms of equipment and process. For sand blasting, only recycling, dust collecting, and strength are usually taken into consideration. However, for shot peening, sieving out deformed or broken steel beads to remove unqualified beads and controlling the flow rate also need to be considered. Further, the size of the beads needs to be graded strictly. In terms of function, differences between sand blasting and shot peening is even more distinct. The main function of sand blasting is to clean and to enhance the roughness of a surface, so as to facilitate the performance of subsequent processes (e.g., electroplating and paint baking). On the other hand, shot peening focuses on increasing fatigue resistance, stress corrosion resistance, and the surface hardness of the workpiece, so as to achieve the effect of extending a service life of the workpiece.

Compared to sand blasting, shot peening machines, which include equipment for increasing the speed of shot peening beads and surrounding walls of an area for processing the workpiece, are easily damaged, given that shot peening materials used by the shot peening machines are relatively larger in particle diameter.

Furthermore, whether by shot peening or sand blasting, an angle and a force used in the conventional art for processing a metal piece with a longer length are fixed and non-adjustable. Even if the metal piece is to be processed manually by operators, the quality of surface finishing cannot achieve the same standard.

SUMMARY OF THE DISCLOSURE

In response to the above-referenced technical inadequacies, the present disclosure provides a shot blasting machine and an impeller apparatus thereof, which not only combines advantages of sand blasting and shot peening, but also provides an impeller apparatus being able to shoot shot-blasting particles at a high speed. A particle size of the shot-blasting particles can be between a sand material of sand blasting and shot peening beads, which can not only provide a cleaning effect and enhance surface roughness, but also increase fatigue resistance and surface hardness of a workpiece, thereby extending a service life of the workpiece.

In response to the above-referenced technical inadequacies, the present disclosure further provides a shot blasting cabinet with adjustable impellers, which includes a plurality of impeller apparatuses. A shot-blasting angle and a height of each of the impeller apparatuses can be adjusted to cooperate with metal workpieces of different thickness, so as to better process surface finishing.

The shot blasting cabinet with adjustable impellers of the present disclosure can provide a longer closed working area, and the impeller apparatuses are distributed in an up-and-down symmetrical manner, so as to keep symmetrical forces.

Preferably, the impeller apparatus provided in the present disclosure can adjust the shot-blasting angle and the height of the impeller apparatuses individually according to different thicknesses of metal boards, and set a plurality of processing curves. During the surface finishing process, the shot-blasting angle and the height of each of the impeller apparatuses are automatically adjusted according to a corresponding one of the originally-set processing curves. Therefore, the surface finishing provided by the shot blasting cabinet is flexible, and the quality of the surface finishing can reach a good consistency.

In one aspect, the present disclosure provides a shot blasting cabinet with adjustable impellers, which includes a cabinet, a plurality of impeller apparatus, and a plurality of adjusting devices. The cabinet has an inlet and an outlet, and the inlet and the outlet define a shot-blasting working line. The plurality of impeller apparatuses are disposed symmetrically on an upper side and a lower side of the cabinet. Each of the impeller apparatuses has a protective housing, a driving device, a pair of rotary plates, and a plurality of impeller blades. The plurality of impeller blades are connected radially between the pair of rotary plates. The driving device connects to one of the rotary plates. The protective housing has a first baffle and a second baffle. The protective housing covers the pair of rotary plates and the plurality of impeller blades. The protective housing defines a shot-blasting exit surface, and the shot-blasting exit surface communicates with an interior of the cabinet. The adjusting devices are arranged correspondingly to the impeller apparatus. Each of the adjusting devices can be used to adjust an angle and a distance of the shot-blasting exit surface relative to the shot-blasting working line. Therefore, the plurality of shot-blasting exit surfaces of the impeller apparatuses are configured to have different angles and heights.

One of the advantages of the present disclosure is that, in the shot blasting cabinet with adjustable impellers as provided, the adjusting device can change heights of two ends of the impeller apparatus, so as to adjust the angle and the height of the impeller apparatus. Not only are the plurality of impeller apparatuses distributed in an up-and-down symmetrical manner, but the shot-blasting condition of the impeller apparatus is arranged in a lateral symmetrical manner along a central position of the cabinet. Therefore, a surface of a workpiece can be processed more efficiently in the present disclosure. However, the above description is merely for illustrative purposes. In the present disclosure, the impeller apparatuses can be adjusted to have different angles and heights for cooperating with metal boards of different thicknesses.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
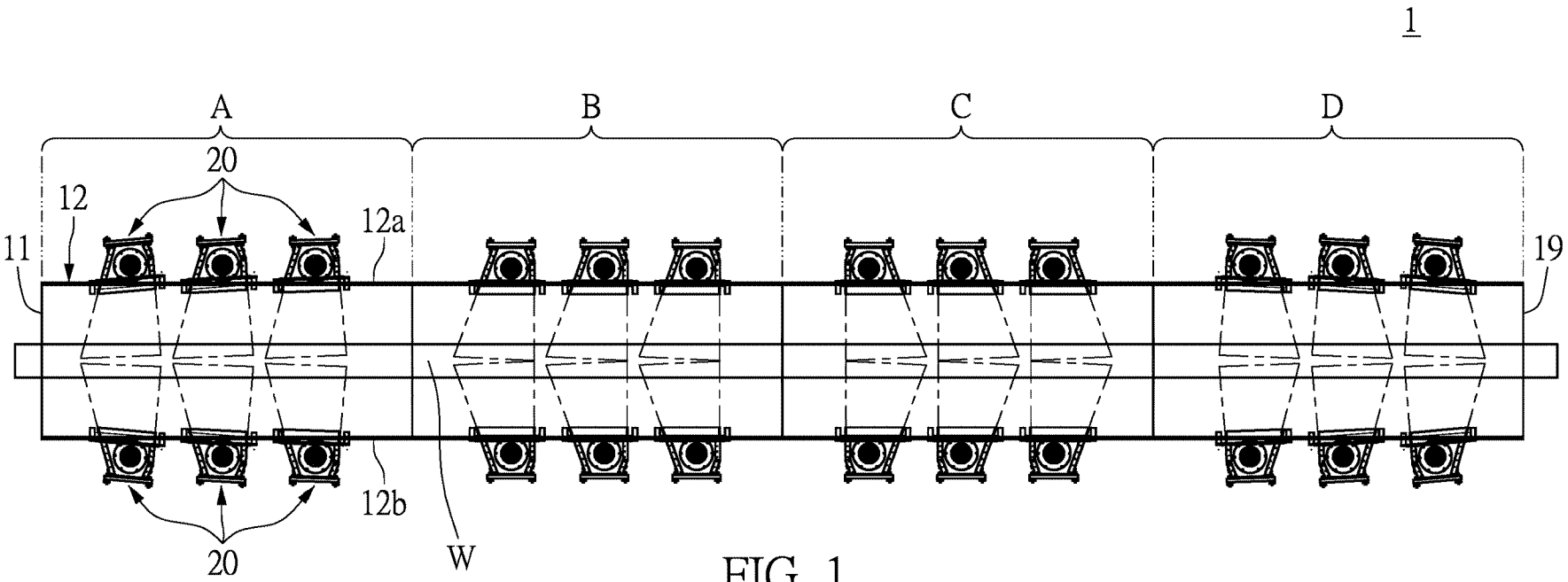
FIG. 1 is a front view of a shot blasting cabinet with adjustable impellers of the present disclosure.
Figure 2C:
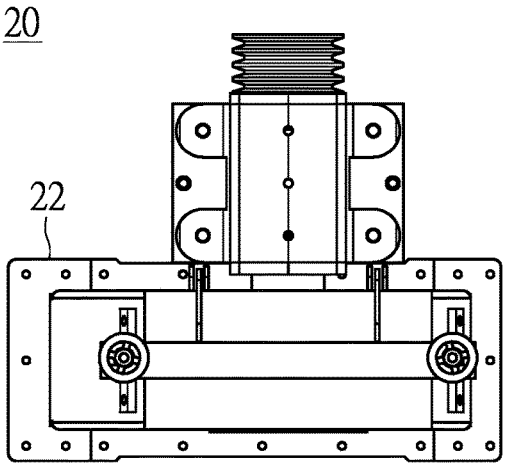
FIG. 2C is a top view of the impeller apparatus of the shot blasting cabinet with adjustable impellers of the present disclosure.
Figure 2B:
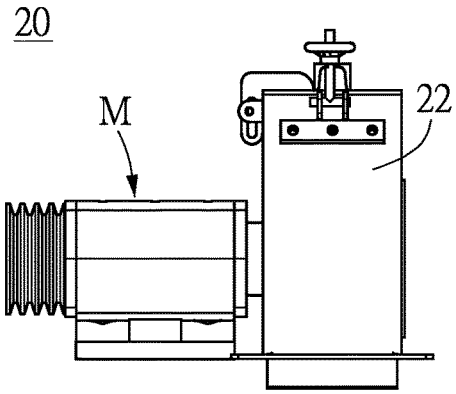
FIG. 2B is a side view of the impeller apparatus of the shot blasting cabinet with adjustable impellers of the present disclosure.
Figure 2A:
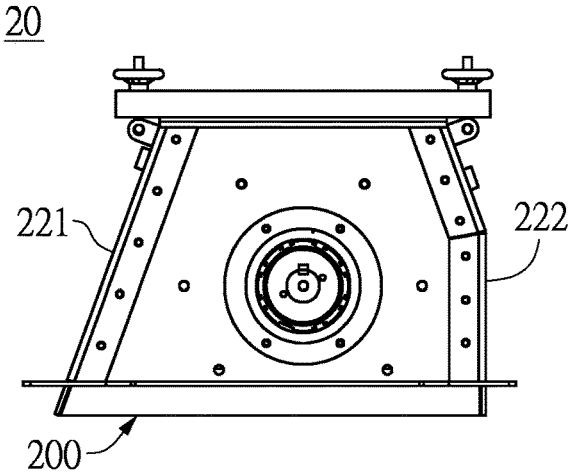
FIG. 2A is a front view of an impeller apparatus of the shot blasting cabinet with adjustable impellers of the present disclosure.
Figure 2D:
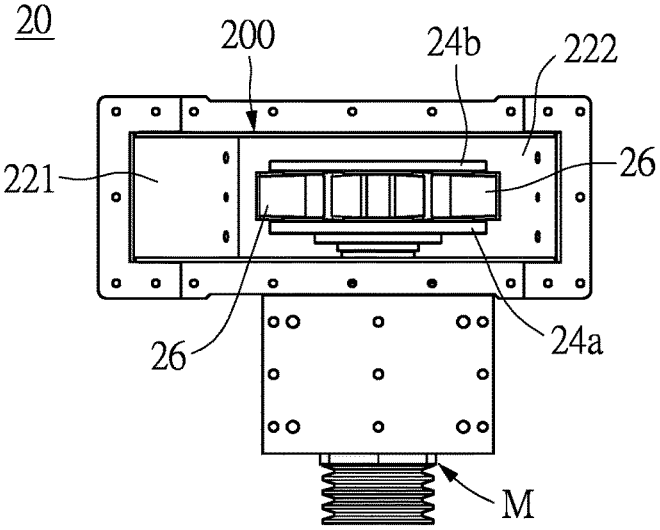
FIG. 2D is a bottom view of the impeller apparatus of the shot blasting cabinet with adjustable impellers of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1, the present disclosure provides a shot blasting cabinet with adjustable impellers 1, which includes a cabinet 12 and a plurality of impeller apparatuses 20. The cabinet 12 has an inlet 11 and an outlet 19, and a shot-blasting working line W is defined between the inlet 11 and the outlet 19 for transporting workpieces. For example, the workpieces may be hung on a hook, or continuously fed by a roller belt, depending on the kinds of workpieces to be shot-blasted. In this embodiment, it is suitable for metal boards, but the present disclosure is not limited thereto. The workpiece to be shot-blasted, such as a roll of the metal board, is transported into the shot-blasting working line W from the inlet 11 and is held and pushed by a roller toward the outlet 19. The impeller apparatuses 20 are disposed symmetrically on an upper side 12*a* and a lower side 12*b* of the cabinet 12, so that upper and lower shot blasting forces can be counterbalanced by each other for maintaining the evenness of the metal board. In this embodiment, the cabinet 12 has four cabinet sub-modules (A, B, C, D), and the cabinet sub-modules (A, B, C, D), are connected to each other in series to form the cabinet 12.

Referring to FIG. 2A to FIG. 2D, the impeller apparatus 20 of this embodiment is described as follows. Each impeller apparatus 20 has a protective housing 22, a driving device M, a pair of rotary plates 24*a*, 24*b*, and a plurality of impeller blades 26. The impeller blades 26 are connected radially between the pair of rotary plates 24*a*, 24*b*. The driving device M connects to one of the rotary plates (i.e., 24*a*). The protective housing 22 has at least a first baffle 221 and a second baffle 222. The protective housing 22 covers the pair of rotary plates 24*a*, 24*b* and the plurality of impeller blades 26. The protective housing 22 is used to contain shot-blasting particles inside the protective housing 22. The walls of the protective housing 22 have a considerable thickness to prevent the shot-blasting particles from passing therethrough. The protective housing 22 defines a shot-blasting exit surface 200, which is an imaginary plane. The shot-blasting exit surface 200 communicates with an interior of the cabinet 12. After being processed, the shot-blasting particles are sent into the protective housing 22, and are shot into the cabinet 12 at a high speed through the shot-blasting exit surface 200 by centrifugal force due to the fast rotation of the rotary plates 24*a*, 24*b*, and the impeller blades 26. The shot-blasting particles of this embodiment can be, for example, ceramic sands, glass beads, nylon sands, quartz sands, emery grits, iron sands, fine metal balls, and so on.

In this embodiment, the first baffle 221 is oblique to the shot-blasting exit surface 200. The second baffle 222 is substantially perpendicular to the shot-blasting exit surface 200. A first adjusting unit 28*a* connects to the first baffle 221 and is close to the shot-blasting exit surface 200. A second adjusting unit 28*b* connects to the second baffle 222 and is close to the shot-blasting exit surface 200.

With regard to details of the impeller apparatus 20, reference can be made to a Taiwan patent application "SHOT BLASTING MACHINE AND IMPELLER APPARATUS THEREOF" filed under application No. 108132992 by the same applicant. The entire content of said patent application can be incorporated into this specification by reference. The present disclosure can utilize the aforesaid related patent application, but it is not limited thereto.

Reference is made to FIG. 3A to FIG. 3D, which are enlarged views of the cabinet sub-modules (A, B, C, D), respectively. One characteristic of the present disclosure is that the adjusting devices are provided. The adjusting devices are arranged correspondingly to the plurality of impeller apparatuses 20. Each of the adjusting devices is used to adjust the angle and the distance of the shot-blasting exit surface 200 related to the shot-blasting working line W, so that the shot-blasting exit surfaces 200 of the impeller apparatuses 20 can be configured to have different angles and heights. Preferably, inclined angles of the shot-blasting exit surfaces 200 of this embodiment are configured along tangent lines of an imaginary parabolic curve from the inlet to the outlet of the cabinet 12.

Figure 3A:
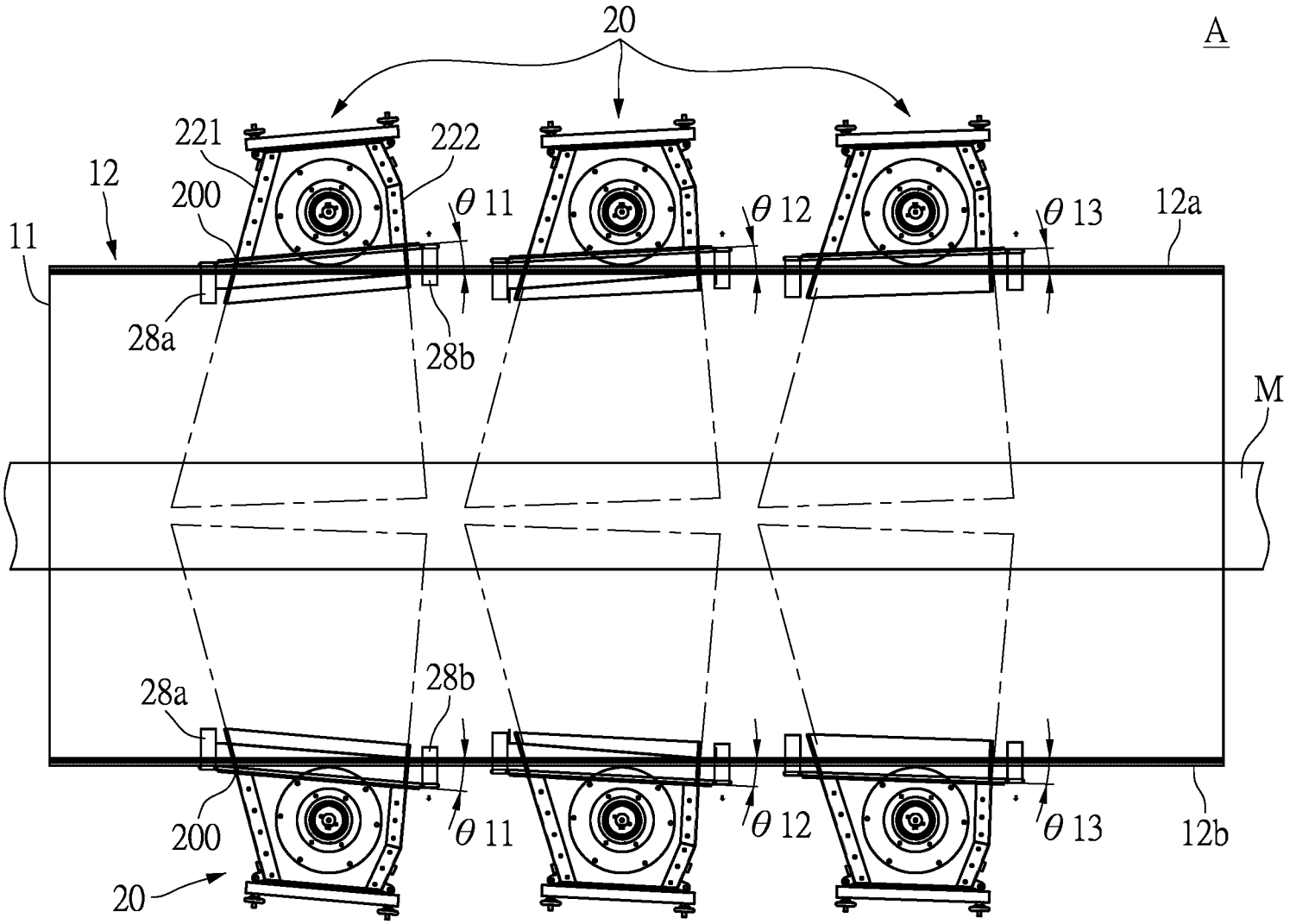
FIG. 3A to FIG. 3D are enlarged front views of each cabinet sub-module of the shot blasting cabinet with adjustable impellers of the present disclosure.

Reference is made to FIG. 3A, which illustrates the configuration of the cabinet sub-module A. Through entering the cabinet 12 from the inlet 11 along the shot-blasting working line W, included angles θ 11, θ 12, θ 13 are formed by the shot-blasting exit surfaces 200 of the plurality of impeller apparatuses 20 and the upper sides 12*a* or the lower sides 12*b* of the cabinet 12. The included angles from the inlet 11 toward a central position of the cabinet 12 are positive angles and decreased progressively. For example, the included angle θ 11 is 5 degrees, the included angle θ 12 is 3 degrees, and the included angle θ 13 is 2 degrees. When a workpiece (such as a metal plate) initially enters into the cabinet 12 from the inlet 11, the shot blasting can be processed in a relatively large angle, so as to remove an oxide layer of a surface of the workpiece at a larger inclined angle with a stronger cleaning effectiveness. After shot blasting by the first impeller apparatus 20, the workpiece is sent to the second impeller apparatus 20. The included angle θ 12 of the second impeller apparatus 20 becomes smaller. After that, the included angle θ 13 of the third impeller apparatus 20 becomes even smaller, so that a normal impact force from shot-blasting can be applied to the workpiece for processing a fatigue resistance or hardness thereof.

Figure 3B:
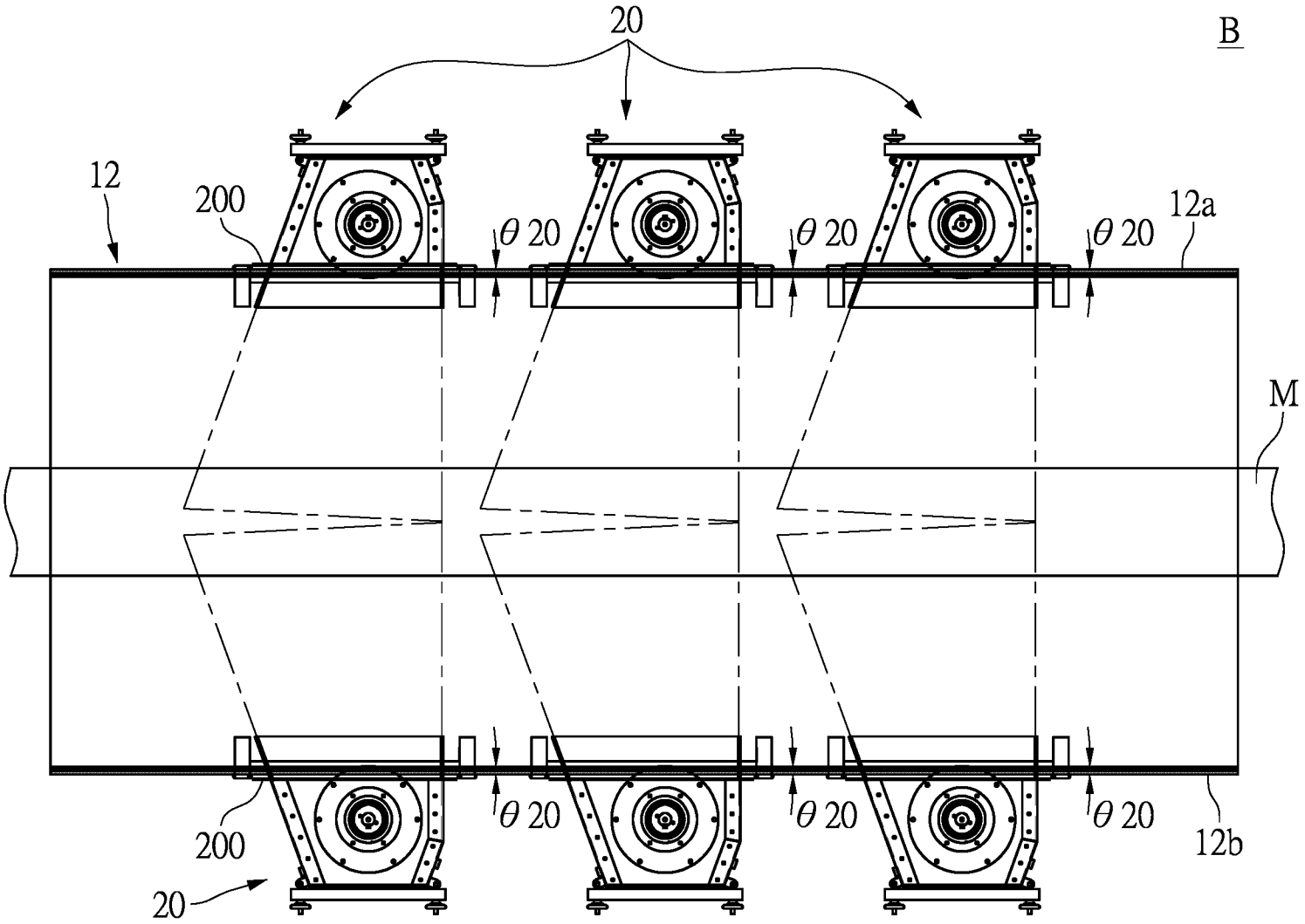
Figure 3C:
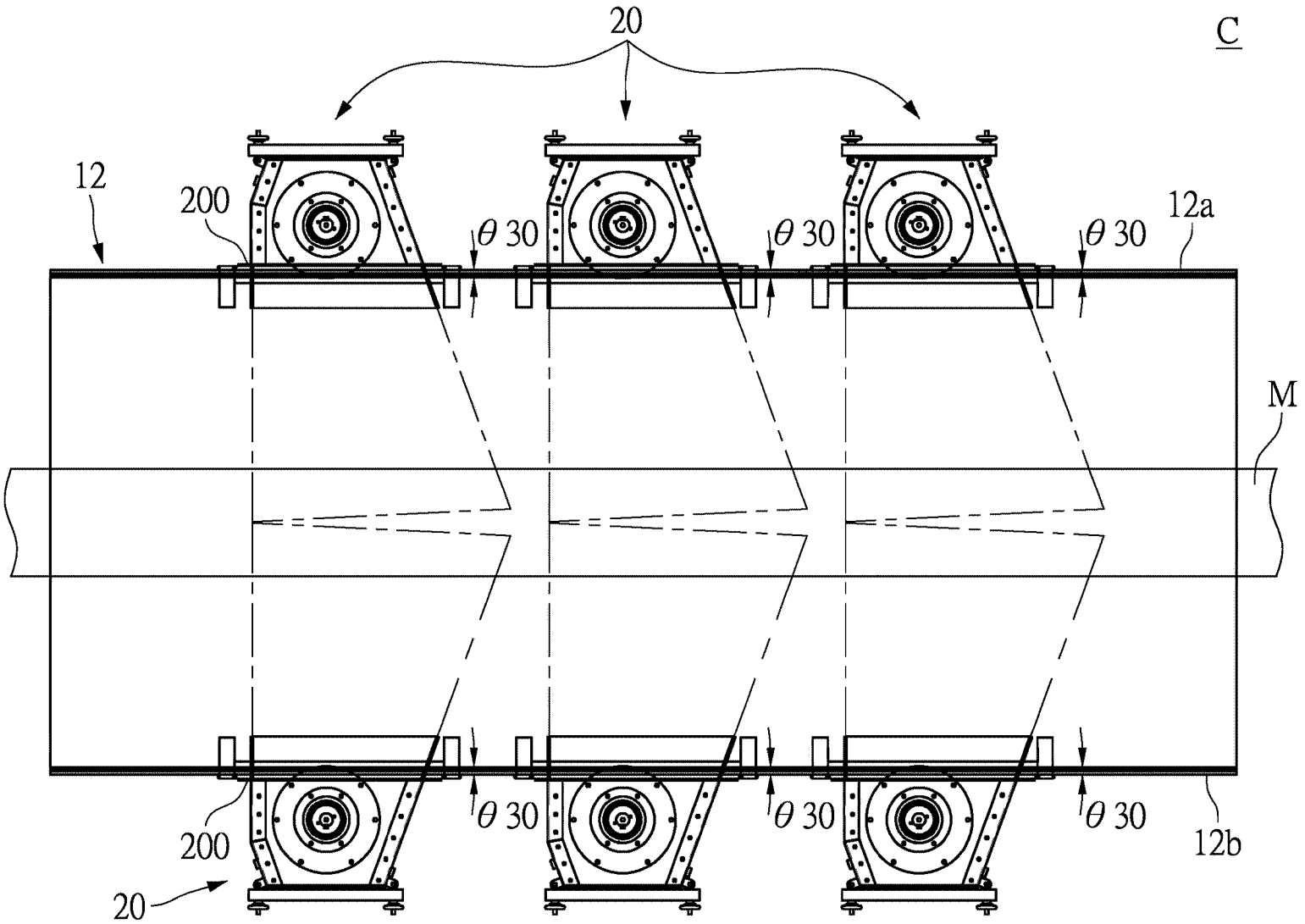

Reference is made to FIG. 3B and FIG. 3C, which illustrates the configuration of the cabinet sub-modules B and C. The included angles θ 20, θ 30, which are close to the central position of the cabinet, are zero degrees. The shot-blasting force is provided fully as a normal impact force on the workpiece, which is to focus more on processing the fatigue resistance or hardness of the workpiece.

Figure 3D:
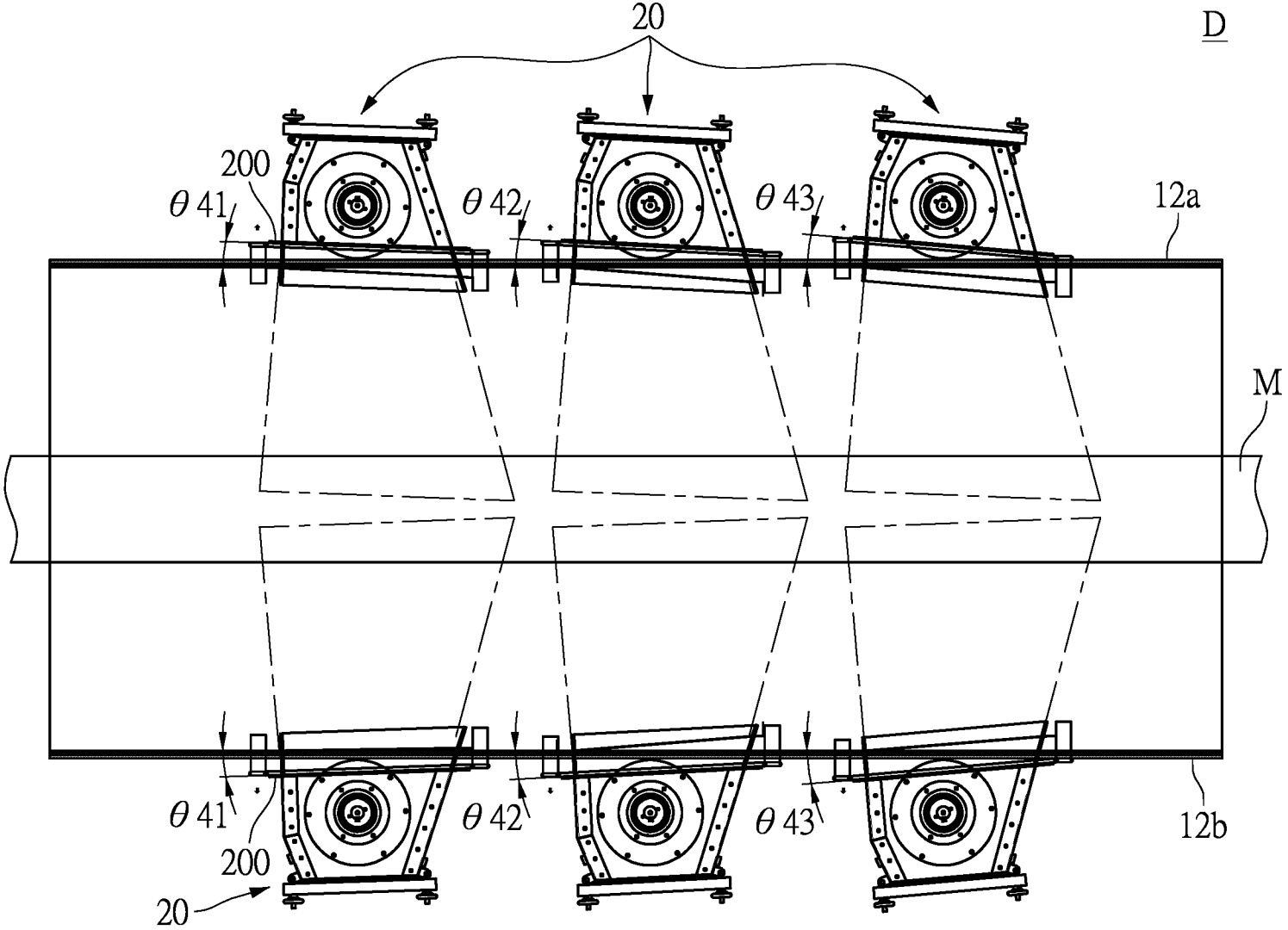

Reference is made to FIG. 3D, which illustrates the configuration of the cabinet sub-module D. The included angles θ 41, θ 42, θ 43 are negative angles and increased progressively from the central position of the cabinet 12 toward the outlet 12. For example, the included angle θ 41 is −2 degrees, the included angle θ 42 is −3 degrees, and the included angle θ 43 is −5 degrees. The first three cabinet sub-modules (A, B, C) have finished most of the shot-blasting work. Therefore, in the last cabinet sub-module D, the shot-blasting angle is substantially contrary to that of the cabinet sub-module A, which can supplement another angle, so that the surface of the workpiece can be more even and more delicate. In other words, the shot-blasting forces of the cabinet sub-module A and the cabinet sub-module D are symmetrical to each other along the central position of the cabinet 12, and the shot-blasting forces of the cabinet sub-module B and the cabinet sub-module C are symmetrical to each other along the central position of the cabinet 12.

Figure 4A:
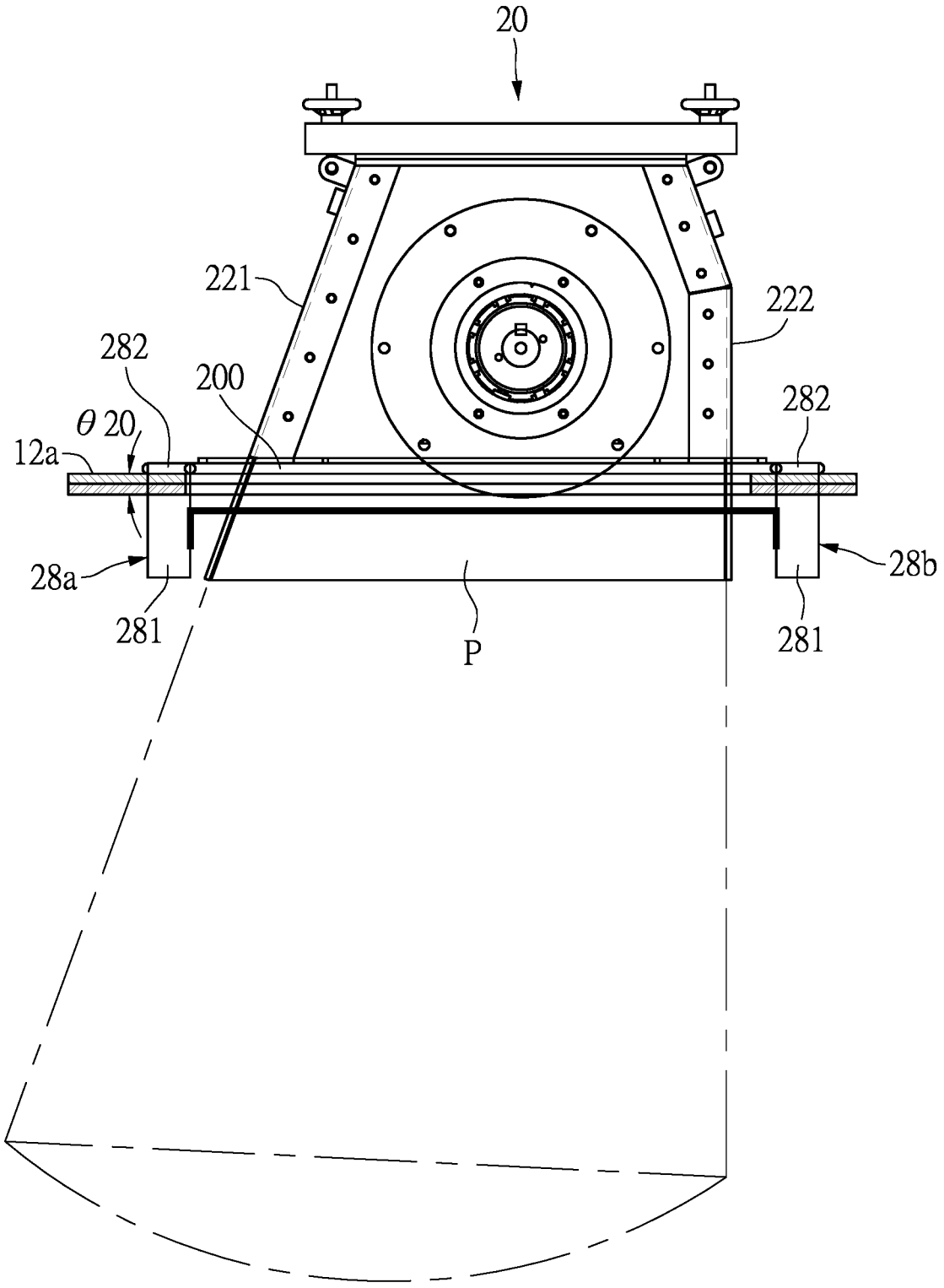
FIG. 4A to FIG. 4C are schematic views of a first embodiment of an adjusting device of the shot blasting cabinet with adjustable impellers from different perspectives according to the present disclosure.
Figure 4B:
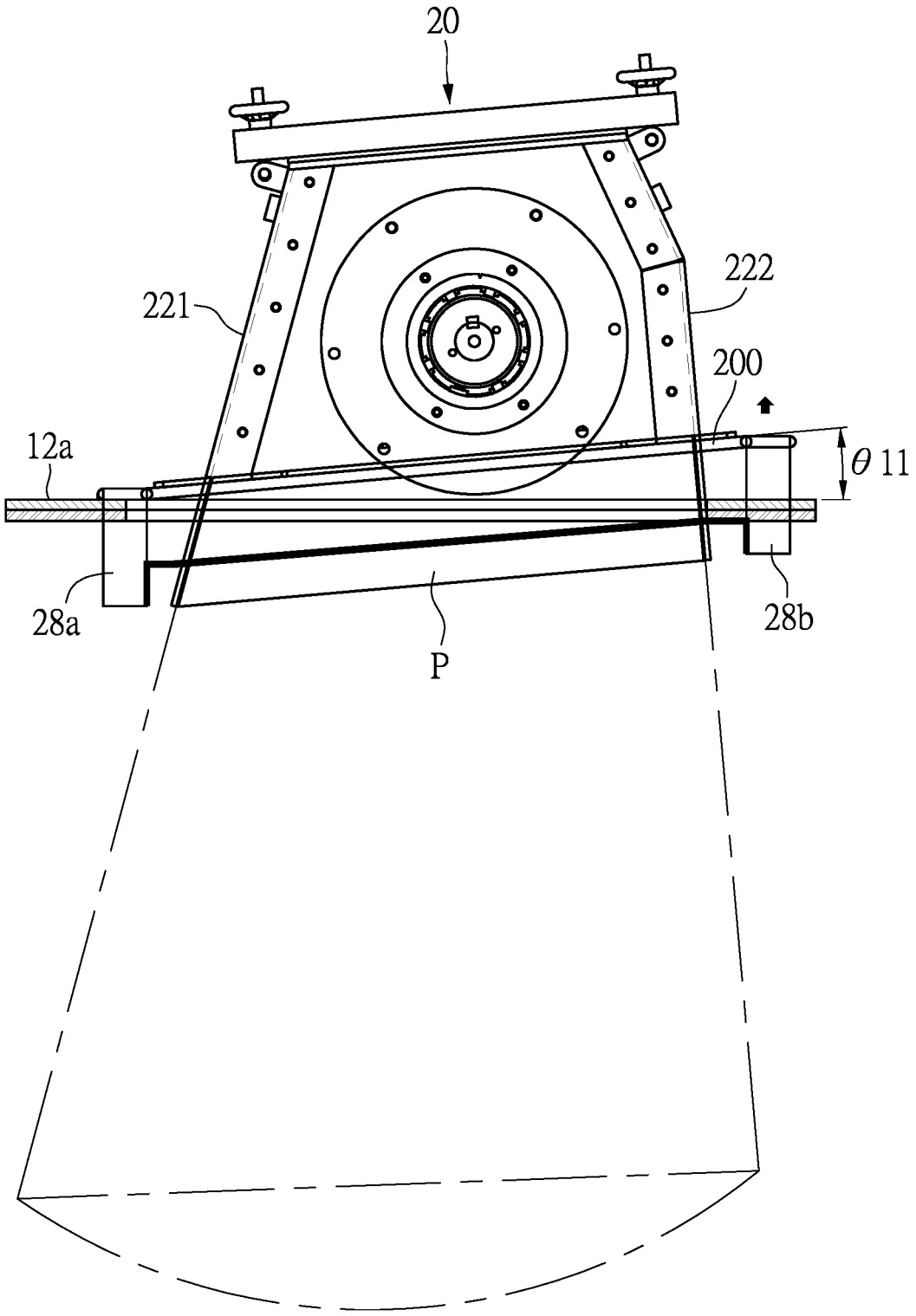
Figure 4C:
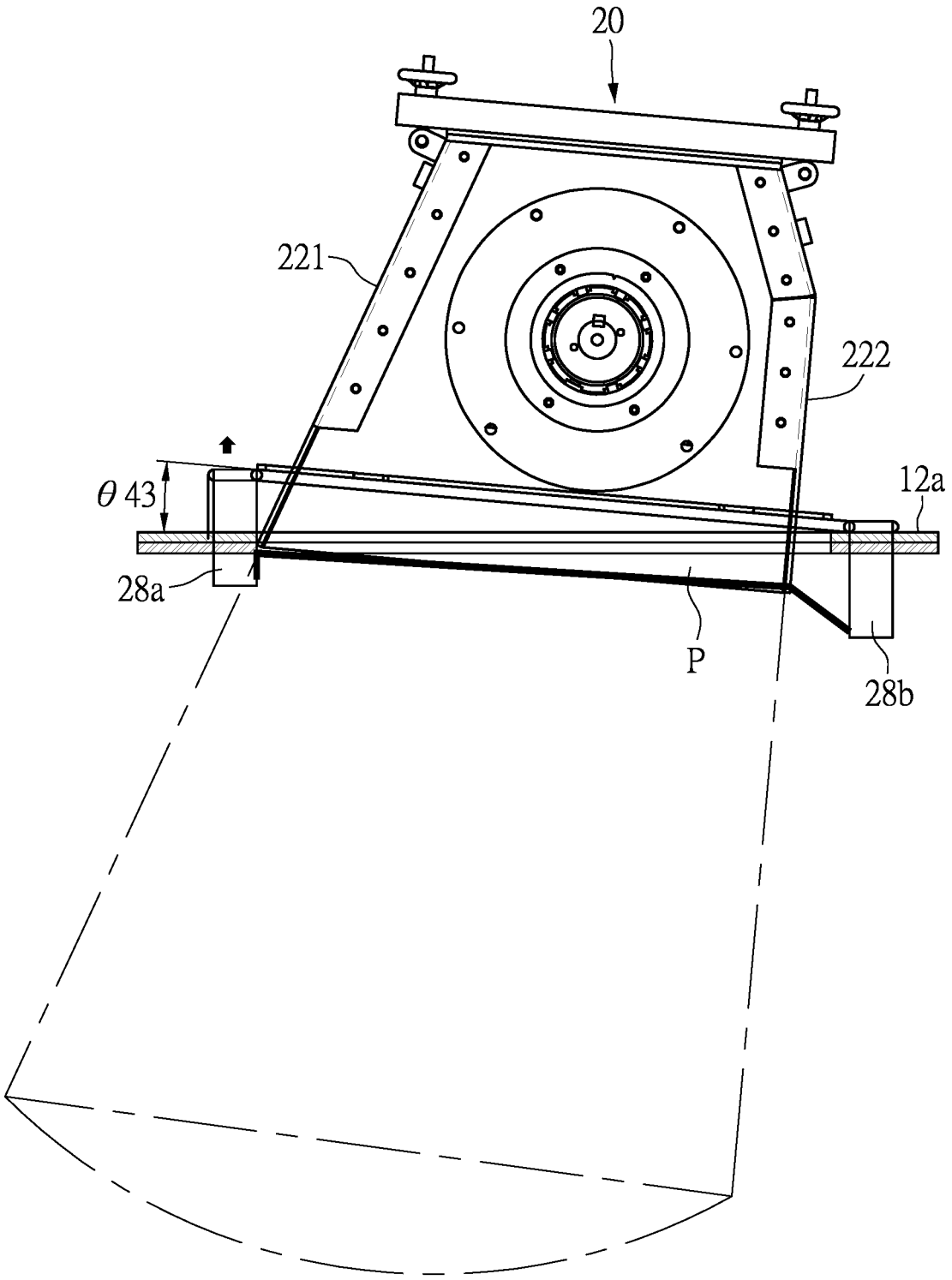

Reference is made to FIG. 4A to FIG. 4C. Each of the adjusting devices of the present disclosure, for instance, has the first adjusting unit 28*a* and the second adjusting unit 28*b*. The first adjusting unit 28*a* is disposed on one end of the protective housing 22, and the second adjusting unit 28*b* is disposed on the other end of the protective housing 22. The first adjusting unit 28*a* can adjust a height of one end of the impeller apparatus 20. The second adjusting unit 28*b* can adjust a height of the other end of the impeller apparatus 20. When two ends of the impeller apparatus 20 are adjusted to different heights, the shot-blasting exit surface 200 is in an inclined state. When the two ends of the impeller apparatus 20 are lifted to form various height differences, the shot-blasting exit surface 200 can be in various inclined states. When the two ends of the impeller apparatus 20 are lifted simultaneously, the height of the shot-blasting exit surface 200 relative to the shot-blasting working line W is changed. Therefore, this embodiment can adjust the shot-blasting angle or the height of the impeller apparatus 20.

In this embodiment, each impeller apparatus 20 further has a sealing cover P, such as a durable rubber sheet, to prevent a gap from forming between the impeller apparatus 20 and the cabinet 12, after the height of the two ends of the impeller apparatus 20 is adjusted. The sealing cover P connects to a bottom periphery of the protective housing 22. The sealing cover P extends close to the first adjusting unit 28*a* and the second adjusting unit 28*b*. After the angle or the height of the impeller apparatus 20 is adjusted, a gap is formed between a bottom flange of the impeller apparatus 20 and the cabinet 12. The sealing cover P of this embodiment can prevent fine particles from escaping during the shot-blasting process. Further, the present disclosure can utilize related filtering and recycling mechanisms to recycle and reuse the shot-blasting particles, so as to conform to the developing trends of environmental protection.

Referring to FIG. 4A, the adjusting unit of this embodiment is described more specifically as follows. The first adjusting unit 28*a* and the second adjusting unit 28*b* respectively have a lifting unit 281 and a hinge 282. The lifting unit 281 of the first adjusting unit 28*a* connects to the first baffle 221 by the hinge 282. The lifting unit 281 of the second adjusting unit 28*b* connects to the second baffle 222 by the hinge 282. The lifting unit 281, such as an alloy block, a gear rack, or a stepper motor with power, can lift or lower two ends of the protective housing 22 of the impeller apparatus 20 in a perpendicular direction.

Figure 5A:
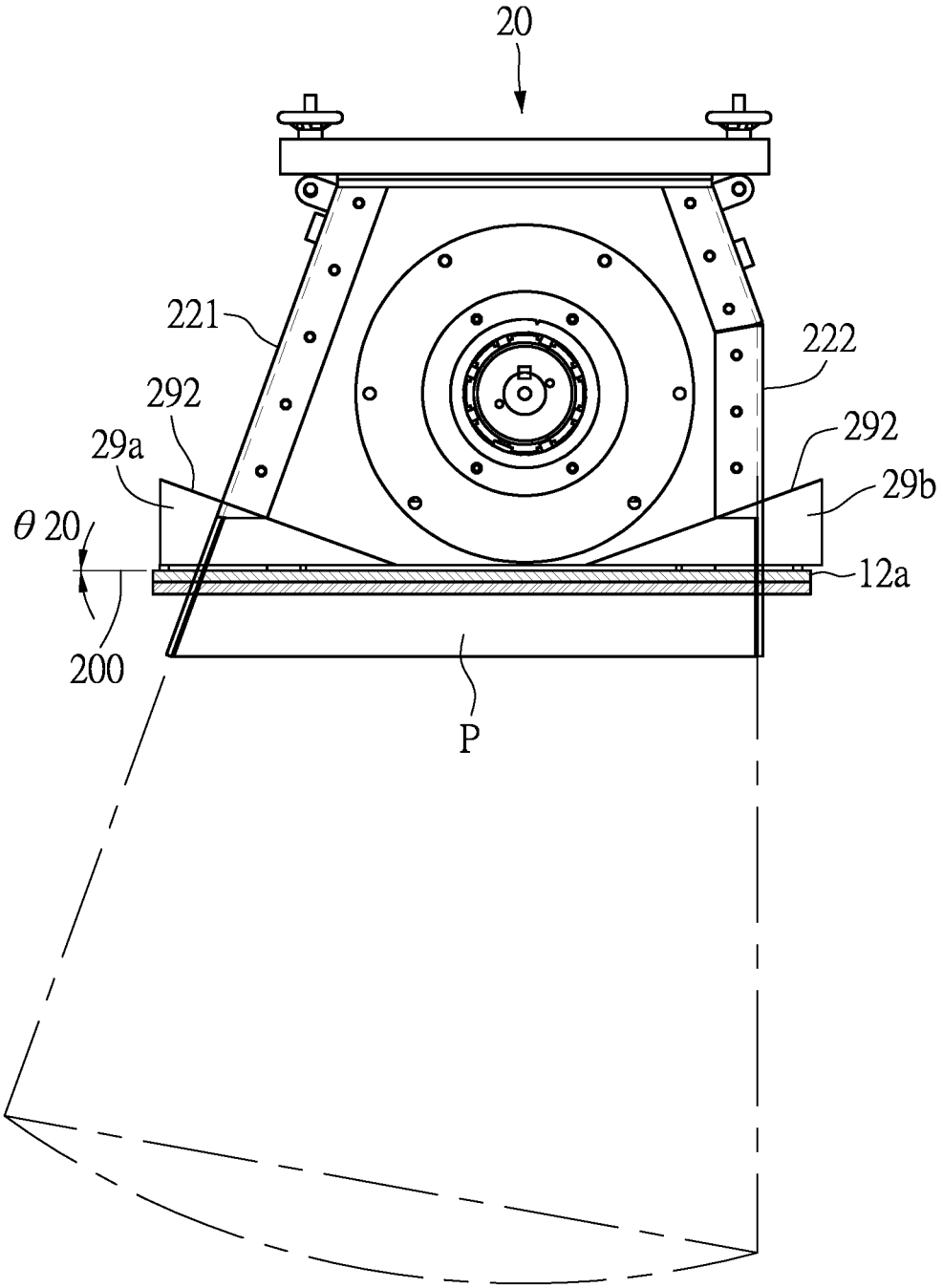
FIG. 5A to FIG. 5C are schematic views of a second embodiment of an adjusting device of the shot blasting cabinet with adjustable impellers from different perspectives according to the present disclosure.
Figure 5B:
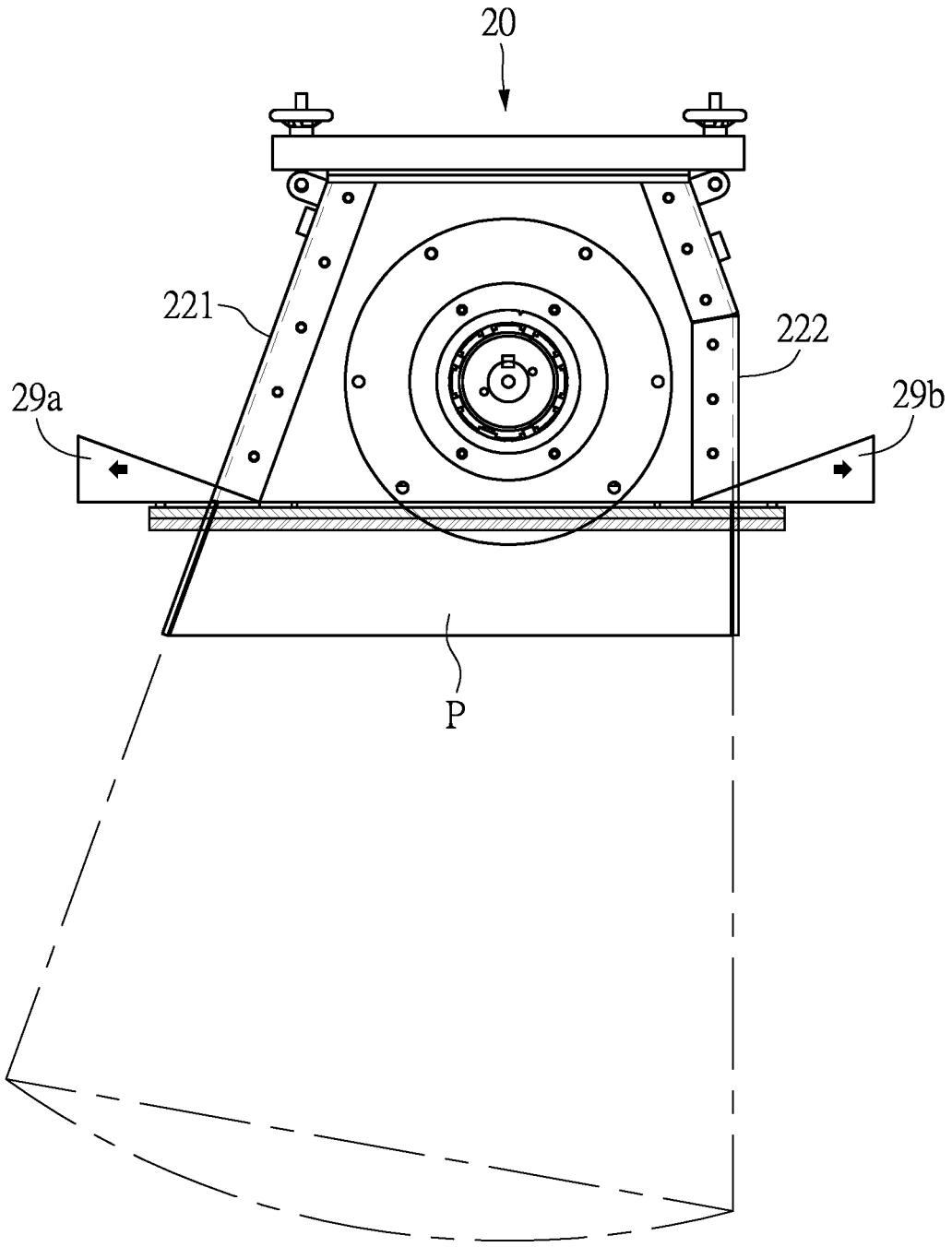
Figure 5C:
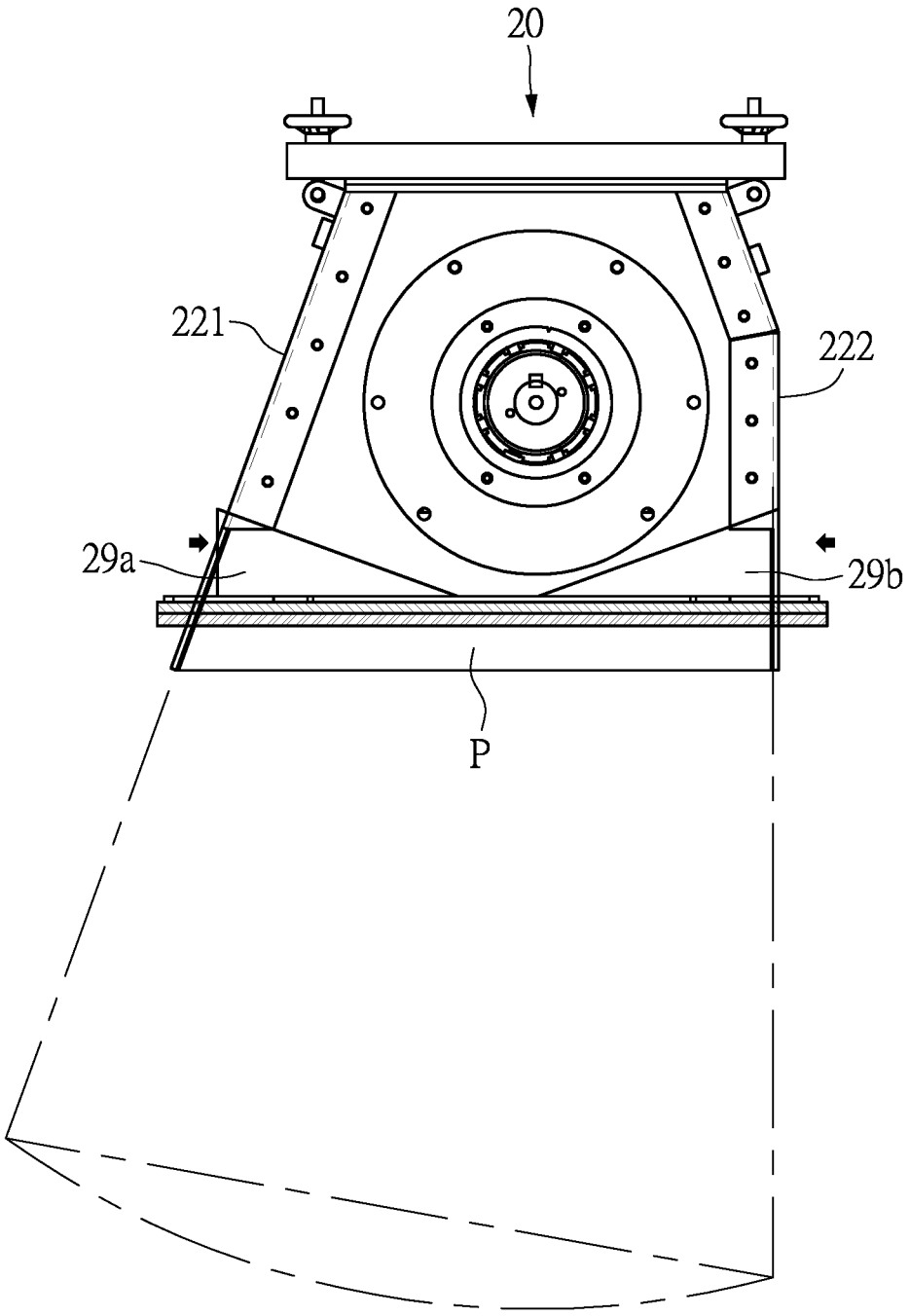

Referring to FIG. 5A to FIG. 5C, a second embodiment of the adjusting device according to the present disclosure is shown. A first adjusting unit 29*a* and a second adjusting unit 29*b* can be a horizontal moving member, such as a wedge block. The traverse moving member forms a bevel 292. The bevel 292 is abutted against bottom ends of two sides of the protective housing 22. The traverse moving member can move relative to the impeller apparatus 20, so as to lift up or lower the two ends of the impeller apparatus 20. By moving the adjusting unit having the bevel 292 left or right, the height of the two ends of the impeller apparatus 20 can be adjusted, and then the inclined angle of the impeller apparatus 20 can be adjusted accordingly.

One of the advantages of the present disclosure is that, the shot blasting cabinet with adjustable impellers has the adjusting device that can change the heights of the two ends of the impeller apparatus, so as to adjust the angle or the height of the impeller apparatus. The cabinet 12 can include the cabinet sub-modules (A, B, C, D), and provides a longer closed working area. The impeller apparatuses 20 are distributed in an up-and-down symmetrical manner. The shot-blasting condition of the impeller apparatuses 20 is distributed in a lateral symmetrical manner along a central position of the cabinet 12. Therefore, a surface of a workpiece can be processed more efficiently in the present disclosure. However, the above description is merely for illustrative purposes. In the present disclosure, the impeller apparatuses can be adjusted to have different angles and heights for cooperating with metal boards of different thickness.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A shot blasting cabinet with adjustable impellers, comprising:

the cabinet having an inlet and an outlet, a shot-blasting working line being defined between the inlet and the outlet;

a plurality of impeller apparatuses disposed symmetrically on an upper side and a lower side of the cabinet, wherein each of the impeller apparatuses has a protective housing, a driving device, a pair of rotary plates, and a plurality of impeller blades, the impeller blades are connected radially between the pair of rotary plates, and the driving device connects to one of the rotary plates, and wherein the protective housing has a first baffle and a second baffle, the protective housing covers the pair of rotary plates and the impeller blades, a shot-blasting exit surface is defined in the protective housing, and the shot-blasting exit surface communicates with an interior of the cabinet; and a plurality of adjusting devices arranged correspondingly to the impeller apparatuses, each of the adjusting devices being configured to adjust an angle and a distance of the shot-blasting exit surface relative to the shot-blasting working line, so that the shot-blasting exit surfaces of the impeller apparatuses are configured to have different angles and heights;

wherein each of the adjusting devices has a first adjusting unit and a second adjusting unit, the first adjusting unit is disposed on one end of the protective housing, the second adjusting unit is disposed on another end of the protective housing, the first adjusting unit is capable of adjusting a height of the one end of the protective housing, and the second adjusting unit is capable of adjusting a height of the another end of the protective housing;

wherein the first adjusting unit and the second adjusting unit each have a lifting unit and a hinge, the lifting unit of the first adjusting unit connects to the first baffle by the hinge, and the lifting unit of the second adjusting unit connects to the second baffle by the hinge.

2. The shot blasting cabinet with the adjustable impellers according to claim 1, wherein the first baffle is oblique to the shot-blasting exit surface, the second baffle is substantially perpendicular to the shot-blasting exit surface, the first adjusting unit connects to the first baffle and is close to the shot-blasting exit surface, and the second adjusting unit connects to the second baffle and is close to the shot-blasting exit surface.

3. The shot blasting cabinet with the adjustable impellers according to claim 1, wherein each of the impeller apparatuses further includes a sealing cover, the sealing cover connects to a bottom periphery of the protective housing and extends close to the first adjusting unit and the second adjusting unit.

4. The shot blasting cabinet with the adjustable impellers according to claim 1, wherein a plurality of included angles are defined between the shot-blasting exit surfaces of the impeller apparatuses and the upper side or the lower side of the cabinet; wherein the included angles from the inlet toward a central position of the cabinet are positive angles and are decreased progressively; wherein the included angles close to the central position of the cabinet are 0 degrees; wherein the included angles from the central position of the cabinet toward the outlet are negative angles and are increased progressively.

5. The shot blasting cabinet with the adjustable impellers according to claim 1, wherein the inlet and the outlet each have a sealing cover.

6. The shot blasting cabinet with the adjustable impellers according to claim 1, wherein the cabinet includes a plurality of cabinet sub-modules, and the plurality of cabinet sub-modules are connected to each other in series to form the cabinet.

7. A shot blasting cabinet with adjustable impellers, comprising:

the cabinet having an inlet and an outlet, a shot-blasting working line being defined between the inlet and the outlet;

a plurality of impeller apparatuses disposed symmetrically on an upper side and a lower side of the cabinet, wherein each of the impeller apparatuses has a protective housing, a driving device, a pair of rotary plates, and a plurality of impeller blades, the impeller blades are connected radially between the pair of rotary plates, and the driving device connects to one of the rotary plates, and wherein the protective housing has a first baffle and a second baffle, the protective housing covers the pair of rotary plates and the impeller blades, a shot-blasting exit surface is defined in the protective housing, and the shot-blasting exit surface communicates with an interior of the cabinet; and a plurality of adjusting devices arranged correspondingly to the impeller apparatuses, each of the adjusting devices being configured to adjust an angle and a distance of the shot-blasting exit surface relative to the shot-blasting working line, so that the shot-blasting exit surfaces of the impeller apparatuses are configured to have different angles and heights;

wherein the first adjusting unit and the second adjusting unit each have a traverse moving member, the traverse moving member forms a bevel, the bevel abuts against bottom ends of two sides of the protective housing, the traverse moving member is capable of moving relative to the impeller apparatus so as to lift up or lower the impeller apparatus.

* * * * *